US007185758B2

(12) United States Patent
Cuomo

(10) Patent No.: US 7,185,758 B2
(45) Date of Patent: Mar. 6, 2007

(54) FOOD CARRIER AND METHOD

(75) Inventor: Angelo V. Cuomo, Staten Island, NY (US)

(73) Assignee: EZ Media Inc., New York, NY (US)

( * ) Notice: Subject to any disclaimer, the term of this patent is extended or adjusted under 35 U.S.C. 154(b) by 0 days.

(21) Appl. No.: 10/215,938

(22) Filed: Aug. 9, 2002

(65) Prior Publication Data

US 2004/0026269 A1 Feb. 12, 2004

(51) Int. Cl.
*B65D 75/00* (2006.01)

(52) U.S. Cl. ..... 206/162; 206/198

(58) Field of Classification Search ..... 206/162, 206/163, 167, 168, 170, 193, 194, 197, 198, 206/199, 427, 562, 563, 564, 565, 434; 229/904; 294/87.2

See application file for complete search history.

(56) References Cited

U.S. PATENT DOCUMENTS

| | | | | |
|---|---|---|---|---|
| 952,302 | A | 3/1910 | Brenner | |
| 962,607 | A | 6/1910 | Wood | |
| 982,919 | A | 1/1911 | Wood | |
| 1,223,202 | A | 4/1917 | Proctor | |
| 2,026,525 | A | 1/1936 | Korte | |
| 2,284,290 | A | 5/1942 | Marshall, Jr. | |
| 2,319,380 | A * | 5/1943 | Wells | 206/162 |
| 2,330,699 | A | 9/1943 | Flamm | |
| 2,339,176 | A | 1/1944 | Lee | |
| 2,373,851 | A | 4/1945 | Potter | |
| 2,405,517 | A | 8/1946 | Plummer | |
| 2,453,908 | A * | 11/1948 | Harhay | 206/193 |
| 2,594,376 | A | 4/1952 | Ameson | |
| 2,630,264 | A | 3/1953 | Holy | |
| 2,728,484 | A | 12/1955 | Farrington | |
| 2,759,629 | A | 8/1956 | Sargent | |
| 2,828,047 | A | 3/1958 | Weiselberg | |
| 2,850,223 | A | 9/1958 | Strauss | |
| 2,991,908 | A | 7/1961 | Conescu | |
| 3,123,213 | A | 3/1964 | Kulig | |
| 3,140,036 | A | 7/1964 | Spery | |
| 3,225,959 | A | 12/1965 | Jamison | |
| 3,266,663 | A | 8/1966 | Ringler | |
| 3,547,339 | A | 12/1970 | Bruce | |
| 3,565,323 | A | 2/1971 | Katzenmeyer | |
| 3,576,274 | A | 4/1971 | Stramaglia | |
| 3,661,417 | A | 5/1972 | Inman | |
| 3,744,704 | A | 7/1973 | Struble | |
| 3,780,906 | A | 12/1973 | Katzenmeyer | |

(Continued)

*Primary Examiner*—Shian T. Luong
(74) *Attorney, Agent, or Firm*—Kramer Levin Naftalis & Frankel; Gregor N. Neff

(57) ABSTRACT

The food carrier has a central vertical support panel with a handle and a pair of trays with beverage cup holders attached to the central support panel. A folded side-wall structure can be unfolded to start the formation of the trays, and a folded bottom panel or two-panel structure unfolds into the side-wall outline to stabilize the side-wall and hold the carrier erect while it is resting on a flat surface thus to make unfolding and loading the carrier quicker and easier. An auxiliary tray can be slipped into the central vertical support to hold solid foods, and both beverages and solid foods can be carried.

Advantageously, the auxiliary tray can have substantially the same structure as the first carrier unit, except is has no beverage-receiving holes. It can be mounted to ride "piggyback" on the first carrier, or it can be used alone.

18 Claims, 5 Drawing Sheets

U.S. PATENT DOCUMENTS 3,868,140 A 2/1975 Gordon
3,958,744 A 5/1976 Herglotz
4,047,610 A 9/1977 Stout et al.
4,053,099 A 10/1977 Lock
4,089,457 A 5/1978 Wood et al.
4,155,502 A 5/1979 Forte
4,205,748 A 6/1980 Wilson
4,620,644 A 11/1986 Kaufman et al.
4,744,613 A 5/1988 Brantingham et al.
4,798,285 A 1/1989 Hernandez
4,852,731 A 8/1989 Cooper
4,895,256 A 1/1990 Johnston
4,969,595 A 11/1990 Teasdale
5,052,552 A 10/1991 Maroszek
5,234,103 A 8/1993 Schuster
5,249,700 A 10/1993 Dumke
5,320,216 A 6/1994 Pangborn
5,332,091 A * 7/1994 Gugler ..... 206/167
5,337,947 A 8/1994 Eskandry
5,415,277 A 5/1995 Berntsen
5,423,420 A 6/1995 Bakx
D367,409 S * 2/1996 Hunter ..... D7/706
5,501,338 A 3/1996 Preston
5,524,814 A 6/1996 Davis
5,609,379 A 3/1997 Harrelson
5,611,425 A * 3/1997 Holley, Jr. ..... 206/144
5,624,024 A * 4/1997 Miess ..... 206/172
5,645,162 A 7/1997 Harreslon
5,695,051 A 12/1997 Hart
5,709,298 A 1/1998 Harris
5,738,217 A * 4/1998 Hunter ..... 206/549
5,765,684 A 6/1998 Van Dore et al.
5,788,081 A 8/1998 Bates
5,797,486 A 8/1998 Picciolo
5,803,264 A * 9/1998 Gersten et al. ..... 206/549
5,813,540 A 9/1998 Vollbrecht et al.
5,816,405 A 10/1998 Carriger, Jr.
5,833,056 A 11/1998 Goldman
5,884,756 A * 3/1999 Holley, Jr. et al. ..... 206/144
5,927,502 A 7/1999 Hunter
5,927,593 A 7/1999 Berkowitz et al.
5,957,276 A * 9/1999 Cutler et al. ..... 206/194
5,975,287 A 11/1999 Negelen
6,000,536 A 12/1999 Piotrowski
6,168,013 B1 1/2001 Gomes
6,202,836 B1 3/2001 Picciolo
6,230,881 B1 * 5/2001 Collurs ..... 206/175
6,341,689 B1 1/2002 Jones
6,443,308 B1 9/2002 Davis
6,598,739 B1 7/2003 Collura
2002/0079237 A1 6/2002 Bakx
2002/0179459 A1 12/2002 Bakx
2003/0213705 A1 11/2003 Woog

* cited by examiner

FOOD CARRIER AND METHOD

This invention relates to food carriers and distribution methods, and particularly to carriers and methods used in distributing prepared foods, including beverages.

A problem of long standing is that of distributing food from distribution stands, stores, restaurants, etc., to people to carry to a distant site at which the food is to be eaten. It is difficult for one to carry much more than one or two beverage cups, or one cup and one item of solid food, if only the hands are available for use in carrying the food.

Food carriers are used when more substantial quantities of food must be carried. However, because the carriers must be relatively low in cost, they usually are relatively flimsy and are easily deformed to cause the food to spill from the carrier.

One type of prior carrier has a pair of foldable trays secured to a central support panel with a hand-hold used for carrying the device. The trays have beverage-receiving holes for use in carrying up to four full beverage cups. An auxiliary tray with a long slot in the bottom is fitted onto the central support panel with the panel extending through the slot. The auxiliary tray typically is used for holding solid foods such as hot dogs. The auxiliary tray can rest upon the tops of the beverage containers below it. The carrier thus can be used to carry food and beverages for several people.

The foregoing type of carrier has several disadvantages.

One disadvantage is that several different motions are required in order to unfold the flattened carrier and prepare it for use. This makes the carrier relatively slow and intricate to use.

Another disadvantage is that the container often will not stand up on a horizontal surface by itself. This makes it more difficult and slower to load the food into the carrier.

It has been suggested that such carriers be used to carry advertising for sponsors who supply the carriers. By doing this the relatively higher costs of the carriers are paid by advertisers. Thus, it is desirable to maximize the surface area available for such advertising without excessive increases in cost.

Accordingly, it is an object of the invention to provide a food carrier and method which eliminate or alleviate the foregoing disadvantages.

In particular, it is an object of the invention to provide a food carrier which is relatively quick and easy to unfold and set up, and thus speeds the food distribution process.

It is another object to provide such a carrier which is relatively sturdy and easy to load and unload, thus further speeding and smoothing the distribution of food.

It is a further object to provide such a carrier with an increased surface area for displaying advertising.

It is an additional object to provide a carrier which is relatively economical to make, and is sturdy and reliable in use.

In accordance with the present invention, the foregoing objects are met by the provision of a food carrier and method having a central support panel with folded trays on opposite sides, each of the trays consisting of a folded side-wall structure which unfolds to provide a side wall, and a folded horizontal support panel which unfolds to fit into the side wall and hold it. This structure holds the carrier erect when positioned on a flat surface, and greatly facilitates the loading of food into the carrier.

Preferably, the horizontal panel has at least one hole for receiving and holding a beverage cup.

A holding structure preferably is provided to hold the horizontal panel relative to the side wall to support the load to be carried.

In one embodiment, the holding structure comprises a projecting surface extending inwardly from the side wall so as to support the horizontal panel and any food resting on that panel. In another embodiment, the holding structure includes a tab on one of the parts which engages the other part.

Preferably, the horizontal panel is structured so as to automatically enter the confines of the side wall when the side wall is unfolded so that the carrier is unfolded and set up for use in a single motion.

Preferably, the horizontal panel is located adjacent the bottom edge of the side wall.

In another embodiment of the invention, in each tray there are two vertically spaced-apart horizontal panels connected to one another, each having at least one beverage-receiving hole aligned with a similar hole in the other panel to support and hold a beverage container.

An optional auxiliary tray is provided. It has a slot in the bottom through which the central panel is inserted. This tray can be used to hold solid food items, with the tray resting on either the tops of beverage containers held in the trays, or on the upper edges of the side-walls.

In another embodiment, the auxiliary tray has the same construction as the main carrier except that its trays have no beverage cup holes and it has a central recess which fits over the central support panel of the carrier. This auxiliary tray can be used independently as a solid food carrier.

The carrier is relatively quick and easy to use. The food server prepares the food to the customer's order. Then, he or she merely unfolds the side-wall structure and places the carrier on a flat surface. Then the server loads the carrier with food. Because the carrier stands erect on its own, the server can use both hands to load the food into the carrier.

If the order is only for liquid foods, such as soup or beverages, the beverage-containing cups are inserted into the receiving holes in the trays, and the carrier is grasped by the handle and carried away by the customer.

If the order also includes solid foods, such as hot dogs, hamburgers, bags of peanuts, potato chips, popcorn, etc., then the auxiliary tray is slipped downwardly onto the central support panel, the sold food is placed in the auxiliary tray, and the customer grasps the handle and carries all of the good items away with one hand.

If the order includes only solid food items, they can be placed in the carrier trays, as long as they are large enough not to pass through the beverage-receiving holes.

Alternatively, the solid food items can be carried in one of the auxiliary trays described above.

Food distribution using the carriers of the invention is made faster and easier, both for the servers and the customers, in many different types of events and locations. For example, the carrier can be used to advantage in distributing food from concession stands in baseball, football, tennis and other stadiums; in basketball and other indoor sports arenas; at picnics, indoor and outdoor political and other meetings, and conventions; at self-serve or other carry-out restaurants; at parties and other social gatherings, and at virtually any function or location where food must be carried by the consumer.

Advantageously, the carrier bears the Advertisements of one or more sponsors who either supply the carriers for free or defray some of their cost. The advertising can include tear-off coupons good for credit against the purchase of merchandise in order to promote the sale of the merchandise.

Advantageously, the carrier of the present invention has an increased exterior surface area for displaying such advertising.

The foregoing and other objects and advantages of the invention will be apparent from or explained in the following description and drawings.

IN THE DRAWINGS

GENERAL DESCRIPTION

Figure 1:
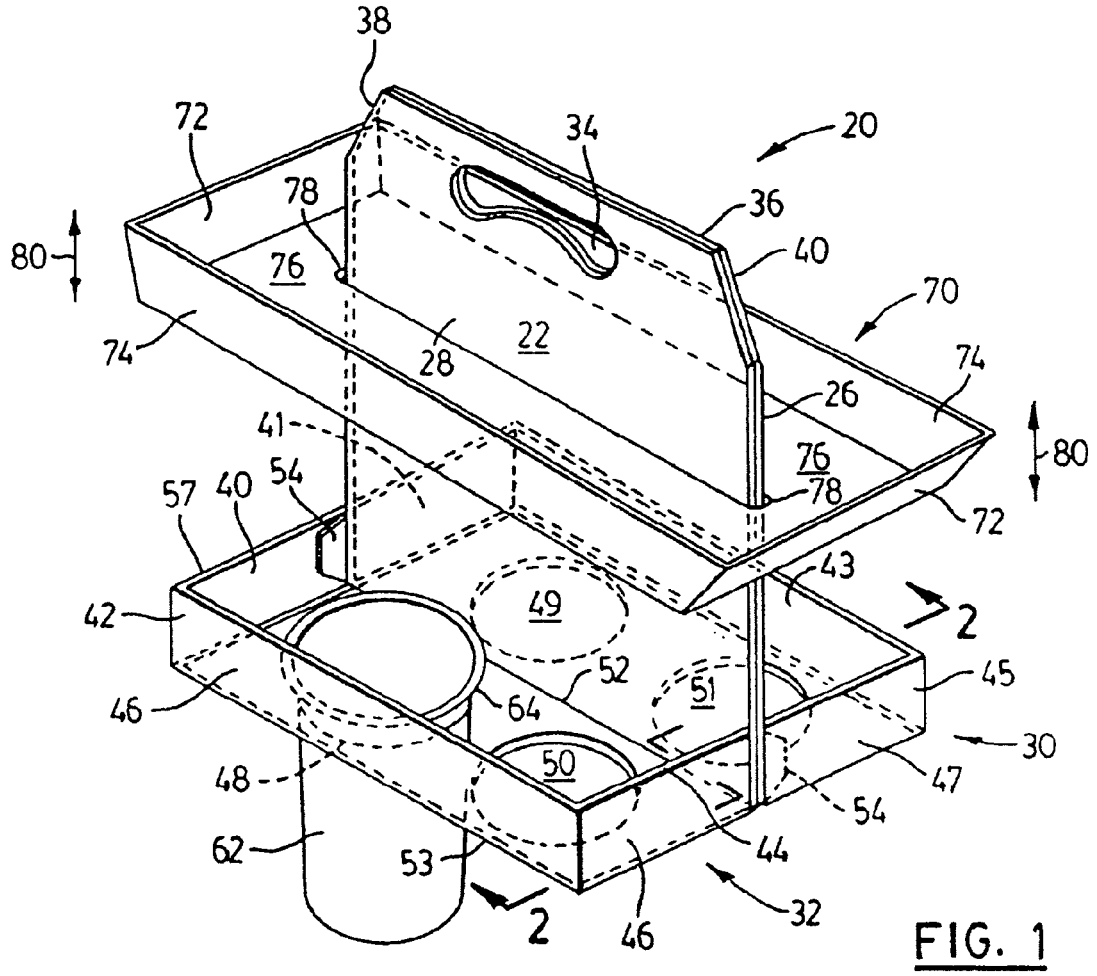
FIG. 1 is a perspective view of one embodiment of the food carrier of the present invention.

Referring first to FIG. 1, the food carrier 20 of the present invention includes a central vertical support panel 22 made of two separate fiberboard panels 26 and 28 adhered together with adhesive to form a laminate.

Extending outwardly from opposite sides of the central panel 22 are two trays 30 and 32 for carrying beverages in up to four cups, such as the cup 62, or solid foods.

Also shown in FIG. 1 is an optional auxiliary tray 70 with side walls 72 and 74 and a bottom wall 76 with an elongated central slot 78.

When the customer orders solid food as well as several beverages, the auxiliary tray 70 is fitted down over the central support panel 22 which extends through the slot 78, and the auxiliary tray 70 slides downwardly until it rests on top of the beverage cups or the upper edges 52 of the trays 30 and 32. A hand-hole 34 is provided in the central support panel 22 and the entire assembly can be carried from a concession stand to the seats in a stadium or the like by using only one hand inserted through the hand-hole 34.

When the customer returns to his or her seat, the customer removes the solid foods from the tray 70, slips the tray 70 off of the central support panel 22, and then removes the beverages from the trays 30 and 32 to distribute to the people for whom the food was ordered.

Advantageously, both the base of the carrier, consisting of the central support panel 22 and the trays 30 and 32, and the auxiliary tray 70 fold flat for compact storage at the concession stand. As it will be explained in greater detail below, the base unit is particularly advantageous in that it can be unfolded very quickly and easily and stands erect on its own so that it can be loaded with beverages very quickly, thus enhancing the efficiency of the food servers using them.

Also in accordance with the present invention, the carrier has an enlarged surface area for the display of advertising by advertisers who buy and supply the carriers to the food vendors or distributors, thus maximizing the advertising value to the advertisers.

Preferred Carrier Base

The preferred carrier base shown in FIG. 1 has a construction which makes the base relatively easy and quick to unfold, and yet enables it to stand erect on a horizontal surface to greatly speed loading food into it.

Figure 2:
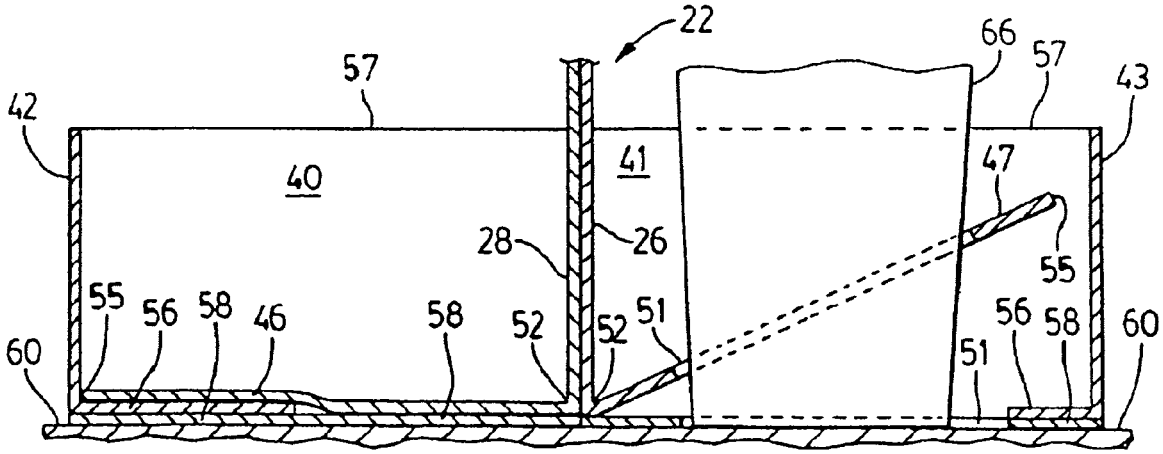
FIG. 2 is a cross-sectional, partially broken-away view taken along line 2—2 of FIG. 1, with modifications to illustrate the operation of the invention.

Referring now to both FIGS. 1 and 2, the tray 32 includes a vertical foldable side wall consisting of sections 40, 42 and 44 which extends from the panel 28 at one end, and is secured at the other end by adhesive to the panel 28 by means of a tab 54 extending outwardly from the panel 28 adjacent its bottom edge.

As it is shown most clearly in FIG. 2, the panel 28 is bent along a fold line 52 to form a horizontal support panel 46 which is shaped and dimensioned so as to fit snugly into the outlines formed by the side wall structure to support the carrier in an erect position when resting on a horizontal surface. The horizontal panel 46 has two relatively large holes 48 and 50 shaped and sized to receive and hold beverage cups, such as the cup 62 which is shown in FIG. 1 fitted into the opening 48.

Typically, the beverage cups are tapered so that they are slightly smaller at the bottom than at the top, and the holes 48 and 50 are dimensioned so as to hold the cup 62 with its upper rim 64 somewhere above the horizontal panel 46, but below the upper edge 57 of the tray 32.

The tray 30 on the other side of the central support panel 22 has a construction which is the mirror image of that shown for the tray 32. Thus, it has a side wall formed of sections 41, 43 and 45, and a horizontal support panel 47 with holes 49 and 51 for receiving beverages. Another tab 54 is used to secure the side wall to the panel 26 with adhesive or the like.

Figure 3:
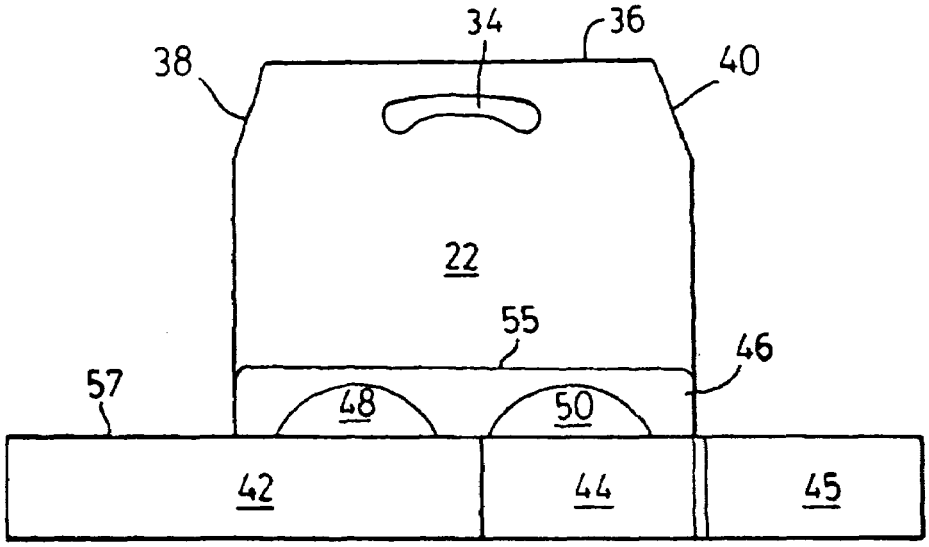
FIG. 3 is a front elevation view of the base portion of the carrier of FIG. 1 folded flat.

FIG. 3 shows the food carrier base of FIG. 1 when folded flat. Both of the side wall structures fold flat, each against its own side, and the horizontal panels 46 and 47 fold upwardly to lie flat against the central support panel 22.

Figure 4:
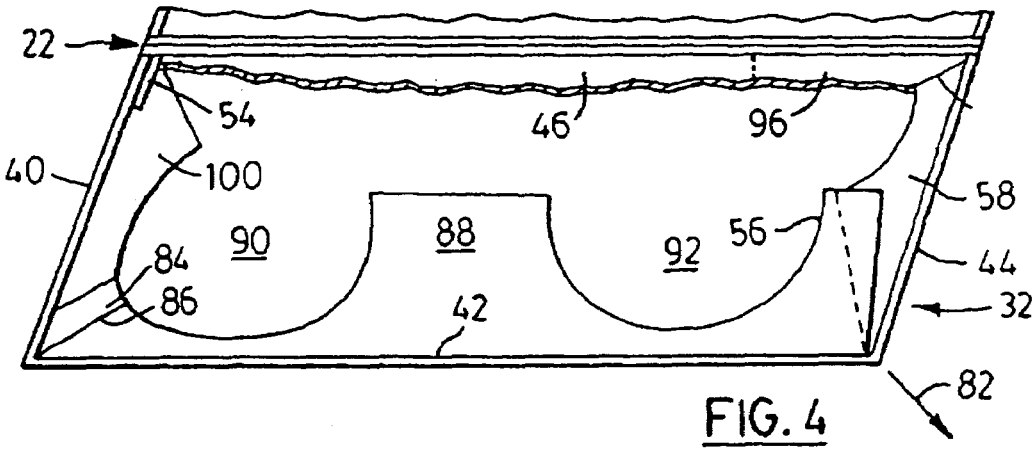
FIG. 4 is a top plan view of a tray of the carrier base shown in FIG. 3, with the tray shown partially unfolded.

When it is desired to unfold the carrier base, the food server merely inserts his or her fingers into the corners of the folded side walls and pulls in the direction indicated by the arrow 82 in FIG. 4, and on the corresponding point in the other tray (not shown in FIG. 4) to unfold the side walls and form the trays 30 and 32.

Figure 5:
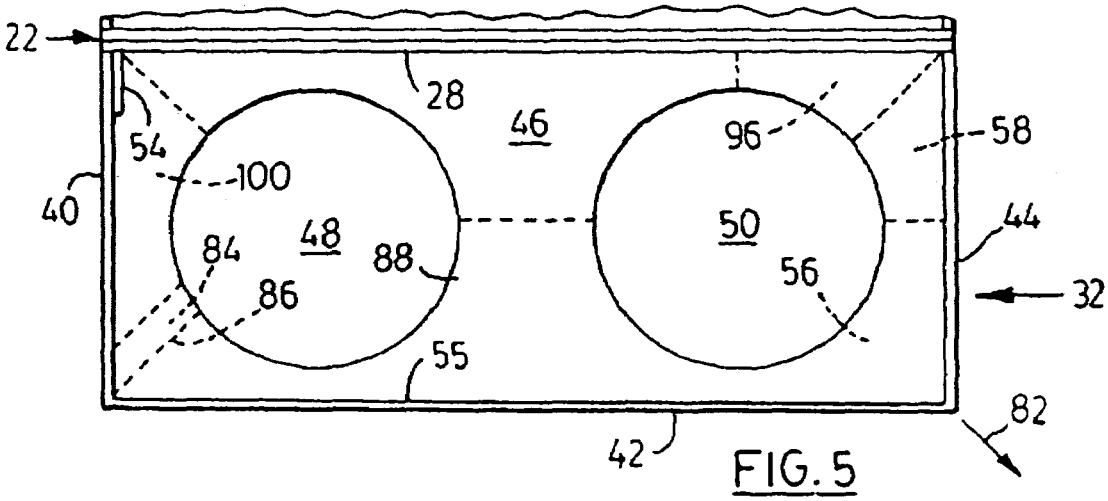
FIG. 5 is a top plan view like that of FIG. 4 with the tray fully unfolded.
Figure 14:
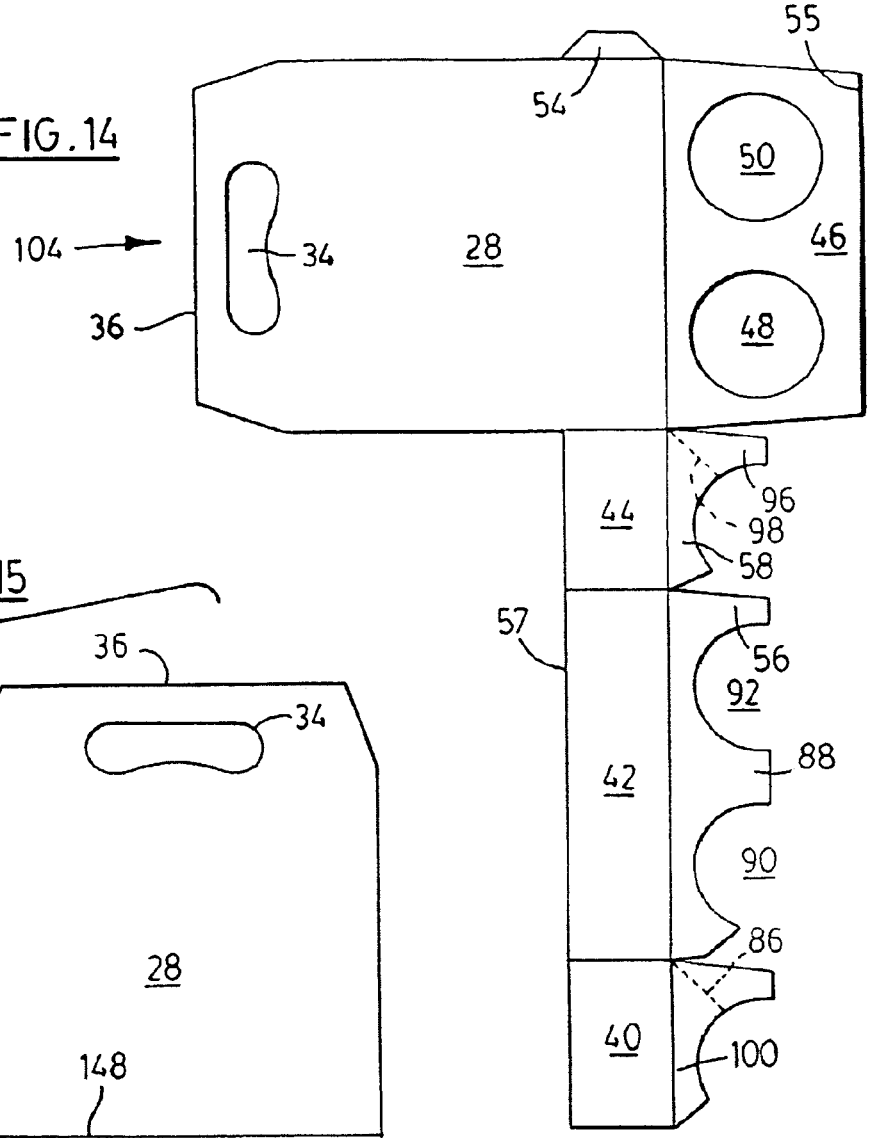
FIG. 14 is a top plan view of the cut form for one half of the carrier base shown in FIG. 1.

Referring now to FIGS. 2, 4, and 5, as well as FIG. 14, extensions 58, projections 56 and 58, 88 and 100 extend inwardly from the bottom edges 53 of the side walls to form a platform upon which the horizontal support panel 46 rests in order to support the relatively heavy weight of multiple large cups filled with beverages.

As it is shown in FIG. 4, the projections are shaped with circular cut-out areas 90 and 92 so as to align with the edges of the holes 48 and 50 when the tray is unfolded.

The projection from the long lateral side 42 has a fold line 86 at one end and a tab 84 which is adhesively attached to the projection 100 extending from the bottom edge of the panel 40.

The projections 56 and 58 are not secured to one another and the projection 56 slides over the top of the projection 58 during unfolding.

The projection 58 from the side wall section 44 has a fold line at 98 and a tab 96 extending underneath the horizontal support panel 46. Preferably, the tab 96 is adhesively secured to the panel 46 so as to provide a means for automatically pulling the panel 46 downwardly into the space between the side walls 40, 42 and 44 as the tray is unfolded.

FIG. 5 shows the tray 32 when it is fully unfolded. The cut outs 90 and 92 align correctly with the holes 48 and 50, and the projections around the periphery provide ample support for the horizontal panel 46.

Referring now to FIG. 2, the outermost edge 55 of each panel 46 and 47 is positioned so that it preferably slightly frictionally engages the side wall 42 or 43 so as to hold it in place once it is fully rotated to its horizontal position. When the trays 30 and 32 are opened in the manner described above, the horizontal support panels 46 and 47 may not be unfolded all the way to the bottom of their respective trays. Instead, the panel is only partially depressed, to the position of panel 47 shown in FIG. 2. This is not an impediment to fast filling of the carrier, and actually may assist in locating a beverage cup such as the one shown at 66 correctly through the opening 51 in the panel 47 and the bottom of the tray. Then, when the carrier is lifted up, the weight of the full drink cups will pull the panels 46 and 47 downwardly and seat them correctly, without any further effort by the food server.

Thus, a single unfolding motion by the food server is all that is necessary to set up the food tray for loading. The horizontal panels 46 and 47, even when they are in the angular position shown in FIG. 2, hold the side walls to their desired shape so as to hold the entire carrier erect when it is resting on a horizontal surface such as the surface 60 shown in FIG. 2.

FIG. 14 shows the fiberboard form 104 used to form one half of the carrier base. An identical form is provided to form the other half of the base, and the two vertical panels are adhered together with adhesive. The other panel portions are secured together, and the assembled unit is folded flat for shipment to the customer.

Figure 6:
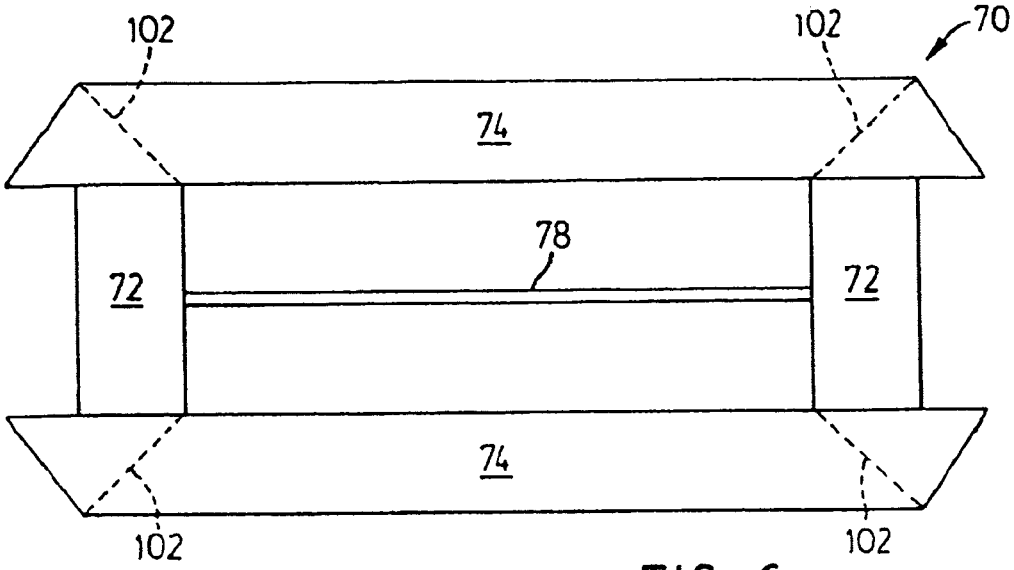
FIG. 6 is a top plan view of the folded auxiliary tray of the carrier shown in FIG. 1.

FIG. 6 shows the auxiliary tray 70 folded flat along fold lines 102. It is a very simple matter to grasp the end panels 72 and pull them apart to erect the auxiliary panel when it is desired to use an auxiliary panel. Of course, it should be understood that the auxiliary tray 70 also can be used by itself to carry solid foods. Although it usually is too flexible to safely carry beverages, it can be used to carry one or possibly two beverages, but with difficulty. It is far better and safer to use the carrier base to carry beverages.

The carrier base construction makes it strong and easily able to support the heavy weight of multiple full cups of beverages, as well as solid foods piled into the auxiliary tray 70. This is particularly so because of the folding vertical side wall construction with the horizontal support panels which hold the side walls in the desired shape.

Although it is preferred that the carrier base be used for carrying beverages, there is no reason why it cannot also be used to carry solid food items, such as hot dogs and hamburgers, if they are large enough so that they will not fall through the holes in the bottoms of the trays.

Figure 12:
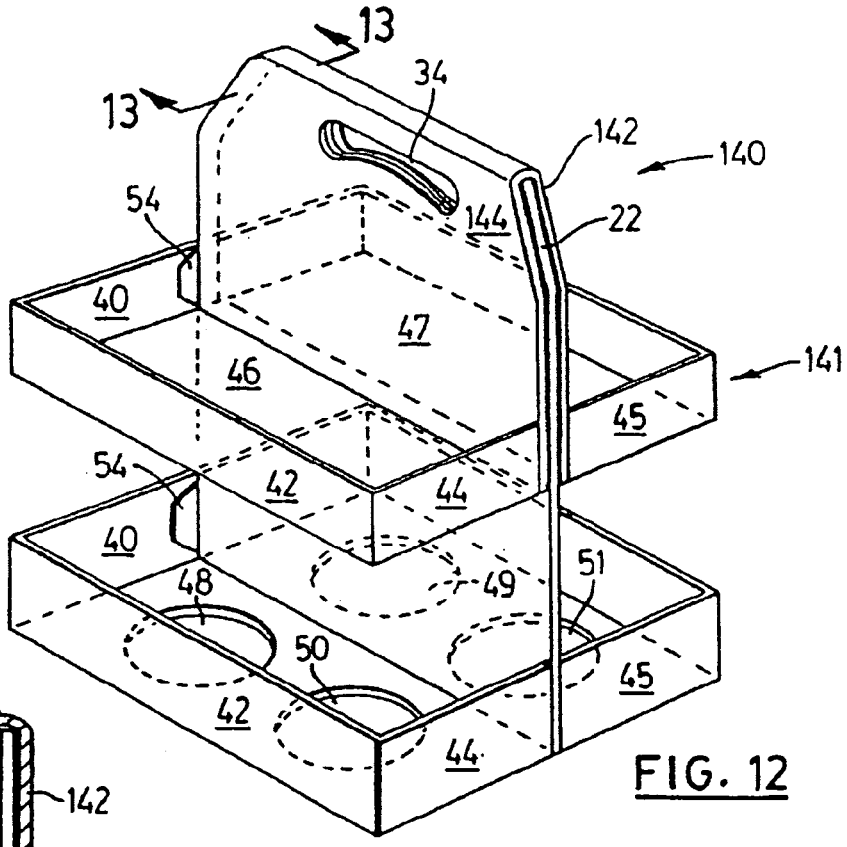
FIG. 12 is a perspective view of another embodiment of the food carrier of the present invention.
Figure 13:
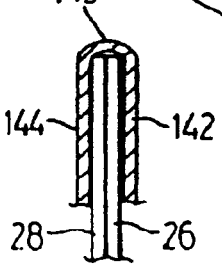
FIG. 13 is a cross-sectional, broken away view taken along line 13—13 of FIG. 12.

In fact, a version of the carrier base shown in FIG. 1 is shown in FIG. 12, without holes in the bottoms of the trays. That version is particularly good for carrying either large or small solid food items. This construction will be described in greater detail below.

Multi-Level Cup Carrier

Figure 7:
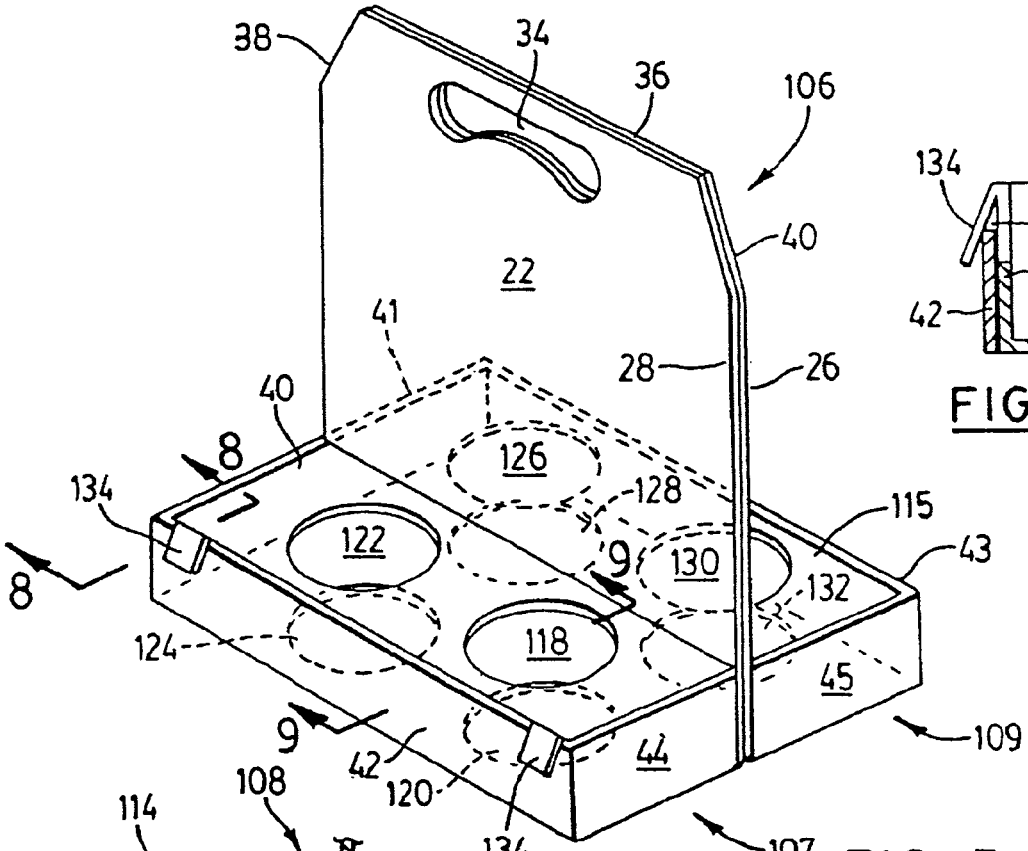
FIG. 7 is a perspective view of another embodiment of the carrier of the invention.

FIG. 7 shows an alternative embodiment of the base of the carrier of the present invention. The construction of the carrier base 106 shown in FIG. 7 is largely the same as that shown in FIG. 1, and the same reference numerals are used for corresponding elements in both Figures of the drawings.

Two trays 107 and 109 are secured adjacent the bottom edge of the central support panel 22. The tray 107 has a side wall with panels 40, 42 and 44, as described above. Similarly, the tray 109 has a side wall formed of panels 41, 43 and 45, also as described above.

Figure 9:
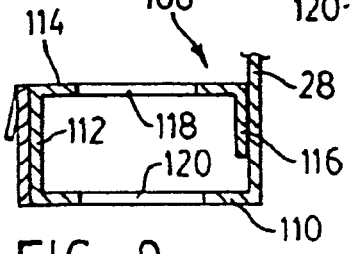
FIG. 9 is a cross-sectional, broken away view taken along line 9—9 of FIG. 7.

As it is shown in FIG. 9, the tray 107 is formed by the side wall in combination with an extension comprising panels 110, 112, 114 and 116 extending from the bottom of the panel 28 and folded as shown in FIG. 9 to form a rectangular structure 108. The rectangular structure is adhesively secured to the panel 28 by adhesive applied to the end section 116.

An upper opening and a lower opening are provided in order to support each beverage cup. The side support provided by two separate spaced locations bearing upon the sides of the cup helps to increase the stability of the cup as it is being carried.

Figure 8:
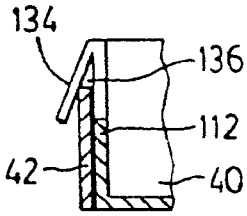
FIG. 8 is a cross-sectional, broken away view taken along line 8—8 of FIG. 7.

The folding structure 108 thus described is secured to the side walls by a pair of tabs 134 cut from the material of the panel 112, as shown in FIG. 8, so as to form the tabs. These tabs fit into notches 136 cut into the edges 42 and 43 of the side wall portions of the construction.

Figure 10:
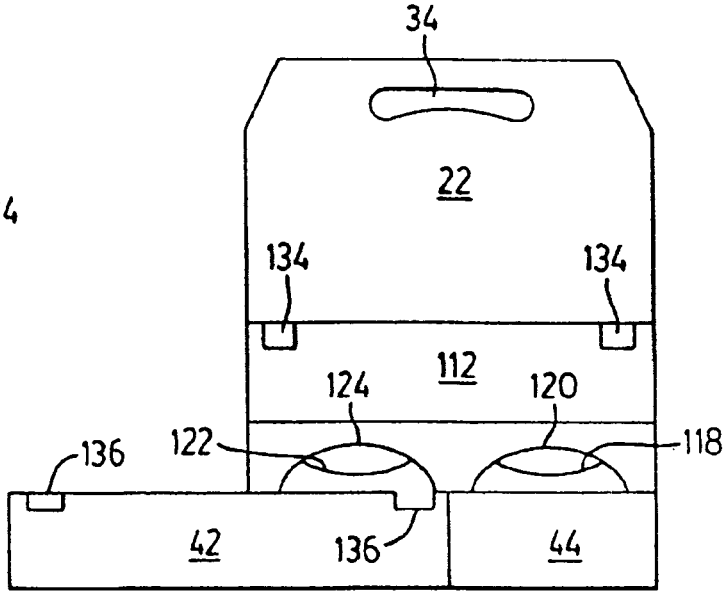
FIG. 10 is a front elevation view of the folded up carrier base which is shown unfolded in FIG. 7.

The carrier base shown in FIG. 7 is shown folded flat in FIG. 10. The structure 108 shown in FIG. 9 is folded upwardly to the position shown in FIG. 10, and the side wall portions are folded to the left, as shown.

Figure 11:
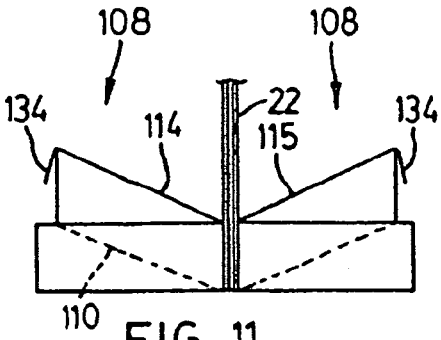
FIG. 11 is a schematic side elevation view of a portion of the base shown in FIGS. 7 and 10 in partially unfolded form.

In unfolding the carrier base, the food server merely pulls on opposite corners of the side walls, as in the FIG. 1 embodiment, and the springiness of the fiberboard causes the structures 108 to rotate partially downwardly to the position shown in FIG. 11, thus causing the side walls to hold a rectangular shape and support the carrier base in an upright erect position to facilitate the loading of the carrier.

The extra openings 118, 122, 126 and 130 formed in the upper wall of each tray helps to stabilize the beverage containers when they are resting on a horizontal surface waiting for the carrier to be lifted upwardly.

When the carrier is lifted upwardly, the weight of the beverage cups pulls the structures 108 downwardly and causes the extending tabs 134 to be seated in the notches 136 in the side wall portions 42 and 43 so as to lock the cup holding portions 108 to the side walls to form a strong and sturdy carrier.

Alternatively, instead of the tabs 134 and notches 136, folding projections such as projections 56, 58, 80, 88 and 100 shown in FIGS. 2–5 can be used as shown in the embodiment of FIG. 1 to support the structures 108 from the bottom.

Although it is not shown in FIG. 7, it should be understood that an auxiliary tray 70, such as that shown in FIGS. 1 and 6, also can be used with the carrier base shown in FIG. 7, in the manner described above with respect to the FIG. 1 structure.

Figure 15:
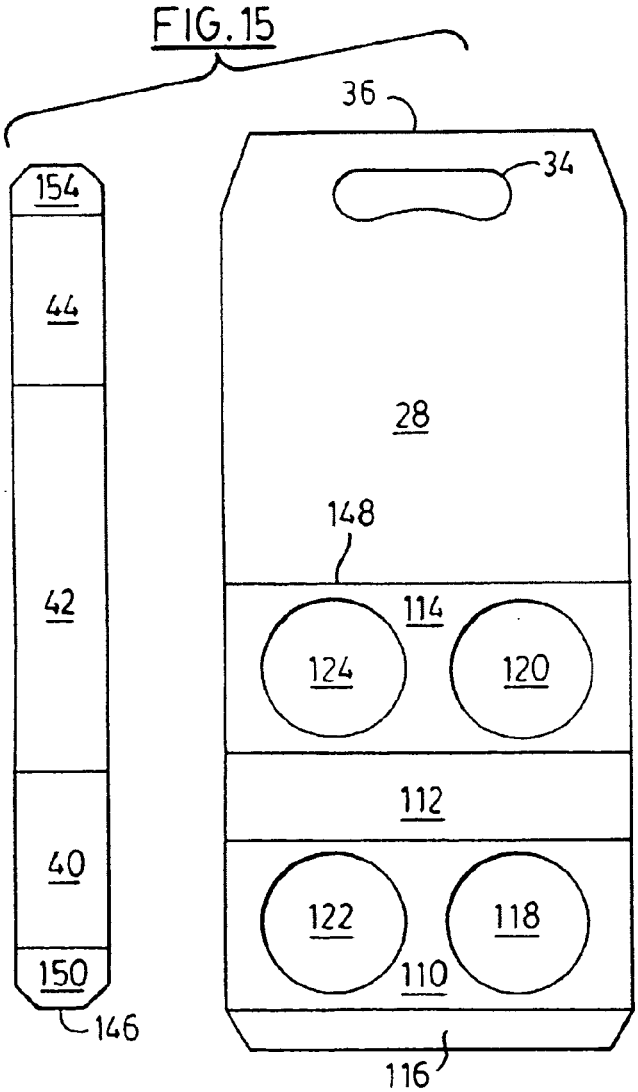
FIG. 15 is a top plan view of the cut form for one half of the carrier base shown in FIG. 12.

FIG. 15 shows the unfolded parts used to form the carrier base shown in FIG. 7. Again, the parts necessary to make only one half of the carrier base are shown, and identical parts would be used to form the other half.

The side wall portion is formed by a strip 146 which is separate from the remainder of the structure, although it could be formed as an integral extension of that structure in the manner of the embodiment shown in FIG. 14, if desired.

The strip 146 has end portions 150 and 154 which are secured to the panel 28 adjacent its bottom edge at the fold line 148.

Piggyback Carrier

FIG. 12 is a perspective view of another food carrier 140 of the present invention. This carrier consists of a base portion which is the same as the base portion shown in either FIG. 1 or FIG. 7, together with an auxiliary tray 141 which is almost identical in construction to the base portion of the unit shown in FIG. 1, except that there are no cup-receiving holes in the horizontal support panels 46 and 47.

Additionally, the two halves of the auxiliary carrier 141 are formed from a single blank or two separate parts are secured together at the top edges 143, so that two panels 142 and 144 are draped over the top edge of the central support panel 22. The panels 142 and 144 have holes 34 positioned to be aligned with the hole 34 in the base unit so that a unitary hand-hole 34 is formed for the combined carrier.

The two panels 142 and 144 are not secured together except at the top edges 143 so that the central support panel 22 of the base unit can fit readily into the opening between the panels 142 and 144.

Thus, the auxiliary carrier 141 rides "piggyback" on the base unit.

The auxiliary carrier 141 has separate utility. When a customer orders only solid foods, or whenever the lack of beverage-receiving holes is not a detriment, the carrier 141 can be used alone. Thus, improved carrying of solid foods as well as liquids is provided. Alternatively, the auxiliary carrier 141 can have beverage-cup receiving holes so as to provide extra beverage carrying capacity.

The height of the auxiliary unit 141 should be selected so that it allows ample room for the cups held in the cup receptacle openings in the base unit to extend a reasonable distance above the bottom of the base unit.

The materials of which the carrier of the present invention can be made need not be expensive. Ordinary, medium weight fiberboard is believed to be sufficient for most purposed. If waterproofing is necessary, a waterproof coating can be applied.

It is within the realm of the invention also to make the carriers out of flexible plastic materials.

If desired, the carriers can be made of plastic materials that are easily washable so that the carriers can be reused.

The invention, in its various embodiments, well satisfies the objectives set forth above. The carrier is easy and quick to unfold, stands upright on its own to allow the service worker maximum utilization of his or her hands to load food into the carrier, and provides a solid, strong, safe carrying means for both liquid and solid foods. Moreover, the invention provides a relatively large amount of exterior advertising space, and can be manufactured at a moderate cost.

It should be understood that when the term "food" is used in the claims of this patent application, unless otherwise stated, the term includes all forms of food including liquid, solid, granular, and other forms.

The above description of the invention is intended to be illustrative and not limiting. Various changes or modifications in the embodiments described may occur to those skilled in the art. These can be made without departing from the spirit or scope of the invention.

What is claimed is:

1. A carrier comprising, in combination, a central support structure, at least one foldable tray secured to said central support structure, said tray comprising a vertical side wall structure and a horizontal support panel having a first edge and an opposite edge, said horizontal support panel being foldably secured at said first edge to one of said central support structure and said vertical side-wall structure, said horizontal support panel having the size and shape to fit into and engage said vertical side-wall structure when both said vertical side-wall structure and said horizontal support panel are either partially or fully unfolded so as to hold said side wall and said carrier erect, and a holding structure extending underneath said horizontal support panel when said carrier is unfolded for holding said horizontal support panel relative to said side-wall structure to support a load to be carried by said carrier.

2. A carrier as in claim 1 in which said horizontal support structure is selected from the group consisting of a solid flat panel and a panel which has at least one hole shaped to receive and hold a beverage container.

3. A carrier as in claim 1 including a linking structure to interconnect said side-wall structure and horizontal support structure together to automatically unfold said horizontal support structure and fit it into said side-wall structure when said side-wall structure is unfolded.

4. A carrier as in claim 1 including another tray having side walls and a bottom wall with an elongated slot in said bottom wall with said central support structure extending through said slot, said central support structure having an upper edge, and a hand-hole adjacent said upper edge.

5. A carrier as in claim 1 including a second foldable tray secured to said central support structure, said central support structure having two opposite sides, one of said trays being secured on one of said sides, and the other of said trays being secured to the other of said sides.

6. A carrier as in claim 5 in which said central support structure comprises a pair of panels secured to one another by means selected from the group consisting of a hinge along one edge of said panels and adhering said panels to one another.

7. A carrier as in claim 1 including an auxiliary food carrier mounted on said central support panel, said auxiliary food carrier having two separate parallel support panels and a food-receiving tray attached to each, said parallel support panels extending downwardly over said central support panel.

8. A food carrier comprising, in combination, a central support panel, a pair of foldable trays secured to said central support panel, each of said trays comprising a vertical side-wall structure and a horizontal support panel foldably secured to said central support panel, said horizontal support panel having the size and shape to fit into said vertical side-wall structure when both said vertical side-wall structure and said horizontal support panel are unfolded so as to hold said side-wall and said carrier erect, and a holding structure for holding said horizontal support panel relative to said side-walls structure to support a load to be carried by said carrier, in which said side wall structure forms a side-wall which has an upper edge and a lower edge, and said horizontal support panel is foldably attached to said central support panel in a plane adjacent the plane of said lower edge of said side-wall, and said holding structure comprising a platform which extends inwardly from said lower edge when said side wall structure is unfolded.

9. A method of distributing food, said method comprising the steps of:

preparing the food to the order of the customer, unfolding a folded food carrier having a central support structure, at least one foldable tray secured to said central support structure, said tray comprising a vertical side wall structure and a horizontal support panel having a first edge and an opposite edge, said horizontal support panel being foldably secured at said first edge to one of said central support structure and said vertical side-wall structure, said horizontal support panel having the size and shape to fit into and engage said vertical side-wall structure when both said vertical side-wall structure and said horizontal support panel are either partially or fully unfolded so as to hold said side wall and said carrier erect, and a holding structure extending underneath said horizontal support panel when said carrier is unfolded for holding said horizontal support panel relative to said side-wall structure to support a load to be carried by said carrier, and placing said food in said trays while said carrier is erect and resting on a horizontal surface.

10. A method as in claim 9 in which said carrier includes a second foldable tray secured to said central support structure, said central support structure having two opposite sides, one of said trays being secured on one of said sides, and the other of said trays being secured to the other of said sides.

11. A carrier comprising a pair of panels, each having an upper edge and a lower edge, two foldable receptacles, each secured to and positioned adjacent said lower edge of each of said panels, each of said receptacles capable of being folded against the panel to which it is secured and unfolded outwardly therefrom, said panels being secured together;

each of said foldable receptacles having first, second, third and fourth vertical side walls, one of said panels forming said fourth vertical side wall, each of said first, second and third vertical side walls having an upper and a lower edge, hinged together along vertical hinge lines to enable said first, second and third side walls to fold flat relative to said fourth side wall, a first bottom flange having first and second opposed edges and opposed side edges, said flange being hinged along one of said first and second edges to the lower edge of one of said second and fourth side walls and being dimensioned to fit into said receptacle as it is being unfolded, with at least one of said side edges of said first bottom flange engaging one of said first and third side walls during unfolding to hold said receptacle open to receive one or more objects, and a linking structure comprising a second bottom flange extending outwardly from the lower edge of one of said first and third side walls and being secured to said first bottom flange and folded along a diagonal line.

12. A carrier as in claim 11 in which said panels are secured together by means selected from the group consisting of a hinge structure at said upper edge of each of said panels, and means for physically attaching said panels to one another.

13. A carrier as in claim 11 in which each of said panels has a hand hole adjacent said upper edge thereof, said holes being aligned with one another when said panels are secured together.

14. A carrier comprising an upwardly-extending central support structure, having an upper portion and a lower portion, a pair of foldable receptacles secured to opposite sides of said central support structure in said lower portion thereof, each of said receptacles comprising three hinged together vertical side walls, each having an upper edge and a lower edge, and a bottom wall comprised of a flange extending from said lower edge of each of said side walls and from said lower portion of said central support structure, at least two of said flanges, at opposite corners of the bottom of said receptacle, being secured to an adjacent one of the other of said flanges and being foldable diagonally to cause said flanges to fold inwardly into said receptacle when said side walls are folded, and to unfold to form a bottom support structure when unfolded.

15. A carrier as in claim 14 in which one of said flanges extends across substantially more than half of the width of said bottom wall to form a multi-ply structure for at least a substantial portion of said bottom wall.

16. A carrier as in claim 15 in which said one of said flanges extends across substantially the whole width of said bottom wall.

17. A carrier as in claim 14 in which said central support structure comprises a pair of panels and the lower portion of each panel forms one of said four side walls of one of said receptacles.

18. A carrier as in claim 17 which said panels are secured together by means selected from the group consisting of a hinge structure at the upper edge of said upper potion, and adhesive.

* * * * *